United States Patent [19]

Enomoto et al.

[11] Patent Number: 4,519,364

[45] Date of Patent: May 28, 1985

[54] VALVE-ACTUATING MECHANISM FOR THREE-VALVE INTERNAL-COMBUSTION ENGINE

[75] Inventors: Masaru Enomoto, Wako; Kenji Kimura, Sayama; Keiichi Kawada, Soka, all of Japan

[73] Assignee: Honda Giken Kogyo Kabushiki Kaisha, Tokyo, Japan

[21] Appl. No.: 553,286

[22] Filed: Nov. 18, 1983

[30] Foreign Application Priority Data

Nov. 24, 1982 [JP] Japan ..... 57-205829

[51] Int. Cl.[3] ..... F02M 23/04; F02M 7/00

[52] U.S. Cl. ..... 123/432; 123/90.27

[58] Field of Search ..... 123/432, 308, 90.27

[56] References Cited

U.S. PATENT DOCUMENTS

| | | | |
|---|---|---|---|
| 3,556,060 | 1/1971 | Henry-Biabaud | 123/432 |
| 4,106,439 | 8/1978 | Kanao | 123/432 |
| 4,167,161 | 9/1979 | Nakagami | 123/432 |
| 4,211,189 | 7/1980 | Hamai | 123/308 |
| 4,216,748 | 8/1980 | Ichida | 123/432 |
| 4,267,811 | 5/1981 | Springer | 123/432 |

FOREIGN PATENT DOCUMENTS

| | | | |
|---|---|---|---|
| 36414 | 3/1979 | Japan | 123/432 |
| 2087479 | 5/1982 | United Kingdom | 123/308 |

*Primary Examiner*—E. Rollins Cross

*Attorney, Agent, or Firm*—Armstrong, Nikaido, Marmelstein & Kubovcik

[57] ABSTRACT

A valve-actuating mechanism for an internal combustion engine having two intake valves and one exhaust valve for each cylinder. The two intake valves are on one lateral side of the engine centerline and the exhaust valve and ignition source are on the other side. A cam shaft is disposed along a straight line substantially equidistant from the intake valves and the exhaust valve. Valve-actuating cams are mounted on the cam shaft. Intake rocker arms and exhaust rocker arms are pivotally mounted on the rocker arm shafts supported on the cylinder head and extending in parallel to the cam shaft. At least one of the two intake rocker arms and the exhaust rocker arm are formed to have the same dimensions to make them interchangeable.

2 Claims, 7 Drawing Figures

VALVE-ACTUATING MECHANISM FOR THREE-VALVE INTERNAL-COMBUSTION ENGINE

BACKGROUND OF THE INVENTION

1. Field of the Invention

This invention relates to a valve-actuating mechanism for a three-valve internal-combustion engine.

2. Description of the Prior Art

The inner surface of each cylinder head of a known three-valve internal combustion engine is provided with a combustion chamber facing the upper surface of a piston fitted slidably in the cylinder. The roof surface of the combustion chamber is provided with two suction valves and one exhaust valve. Such an internal-combustion engine has a high suction efficiency, and is capable of providing a high output. However it has a large number of valves for each cylinder, which means that the cost of manufacturing the engine increases. Additionally, the load on the cam shaft actuating these valves is high. A high load on a cam shaft can cause deflections thereof, and the timing of the operations of the valves is often disrupted slightly. In order to prevent such problems, it is necessary to increase the rigidity of the cam shaft, but this results in an increase in the weight of the engine as a whole.

SUMMARY OF THE INVENTION

Therefore it is an object of the present invention to provide a valve-actuating mechanism for a three-valve internal-combustion engine which is provided with two intake valves and one exhaust valve for each cylinder with one of the intake valve rocker arms and the exhaust valve rocker arm being formed to the same dimensions to make these two rocker arms interchangeable. Further, a valve-actuating cam shaft provided in the valve mechanism is so formed that it does not deflect even if its diameter is not increased, so that the above problems can be eliminated.

According to a first embodiment of the present invention, a valve-actuating mechanism for a three-valve internal-combustion engine having two intake valves and one exhaust valve is provided with a singl cam shaft disposed along a straight line substantially equidistant from the intake valves and exhaust valve. Valve-actuating cams mounted on the cam shaft are connected to the upper ends of the intake valves and exhaust valve by intake rocker arms and an exhaust rocker arm pivotably supported on rocker arm shafts. One of the intake rocker arms and the exhaust rocker arm are formed to have the same dimensions to make these two rocker arms interchangeable.

According to a second embodiment of the present invention, a valve-actuating mechanism for a three-valve multi-cylinder internal-combustion engine having two intake valves and one exhaust valve for each cylinder is provided with a single cam shaft disposed along a straight line substantially equidistant from the plurality of pairs of intake valves and the plurality of exhaust valves. Valve-actuating cams mounted on the cam shaft are connected to the stem ends of the intake valves and exhaust valves by intake rocker arms and exhaust rocker arms pivotably supported on rocker arm shafts. One of each pair of intake rocker arms and the exhaust rocker arm are formed to have the same dimensions to make these two rocker arms interchangeable. The valve-actuating cams consists of two intake valve-actuating cams and one exhaust valve-actuating cam for each cylinder mounted on parts of the cam shaft which are adjacent to one another and are between two bearings rotatably supporting the cam shaft.

BRIEF DESCRIPTION OF THE DRAWINGS

The above and other objects as well as advantageous features of the invention will become apparent from the following description of the preferred embodiments taken in conjunction with the accompanying drawings.

FIGS. 1–5 show a first embodiment of a valve-actuating mechanism according to the present invention, wherein:

FIG. 1 is a longitudinal section taken along the line I—I of FIG. 3, of an internal-combustion engine provided with the embodiment;

FIG. 2 is a longitudinal section taken along the line II—II of FIG. 3, of the internal-combustion engine;

FIG. 3 is a bottom view seen from the line III—III of FIG. 1, of the cylinder head;

FIG. 4 is a plan view seen from the line IV—IV of FIG. 1, of the valve-actuating unit; and FIG. 5 is a schematic diagram of the valve-actuating elements.

FIGS. 6 and 7 show a second embodiment of a valve-actuating mechanism according to the present invention wherein:

FIG. 6 is a bottom view, similar to FIG. 3, of the cylinder head; and

FIG. 7 is a plan view, similar to FIG. 4, of the valve-actuating unit thereof.

DESCRIPTION OF THE PREFERRED EMBODIMENTS

Figure 1:
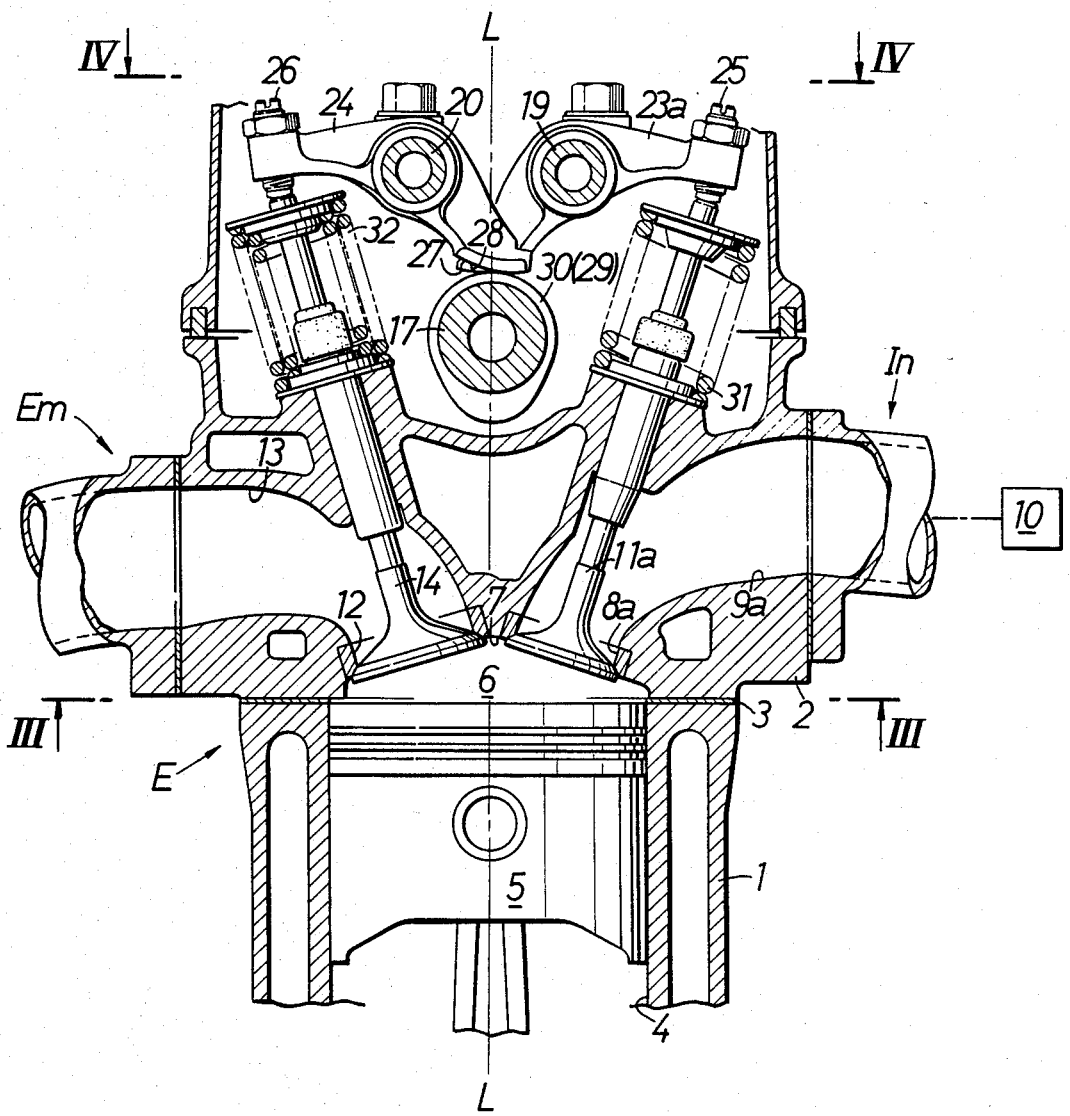
Figure 2:
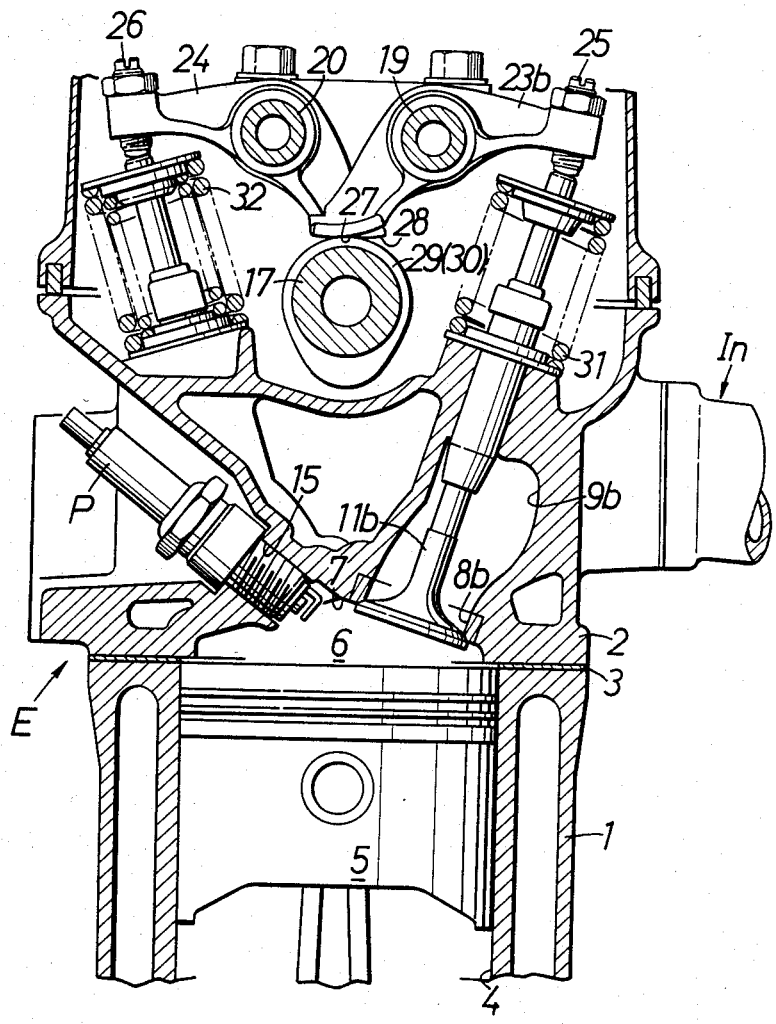
Figure 3:
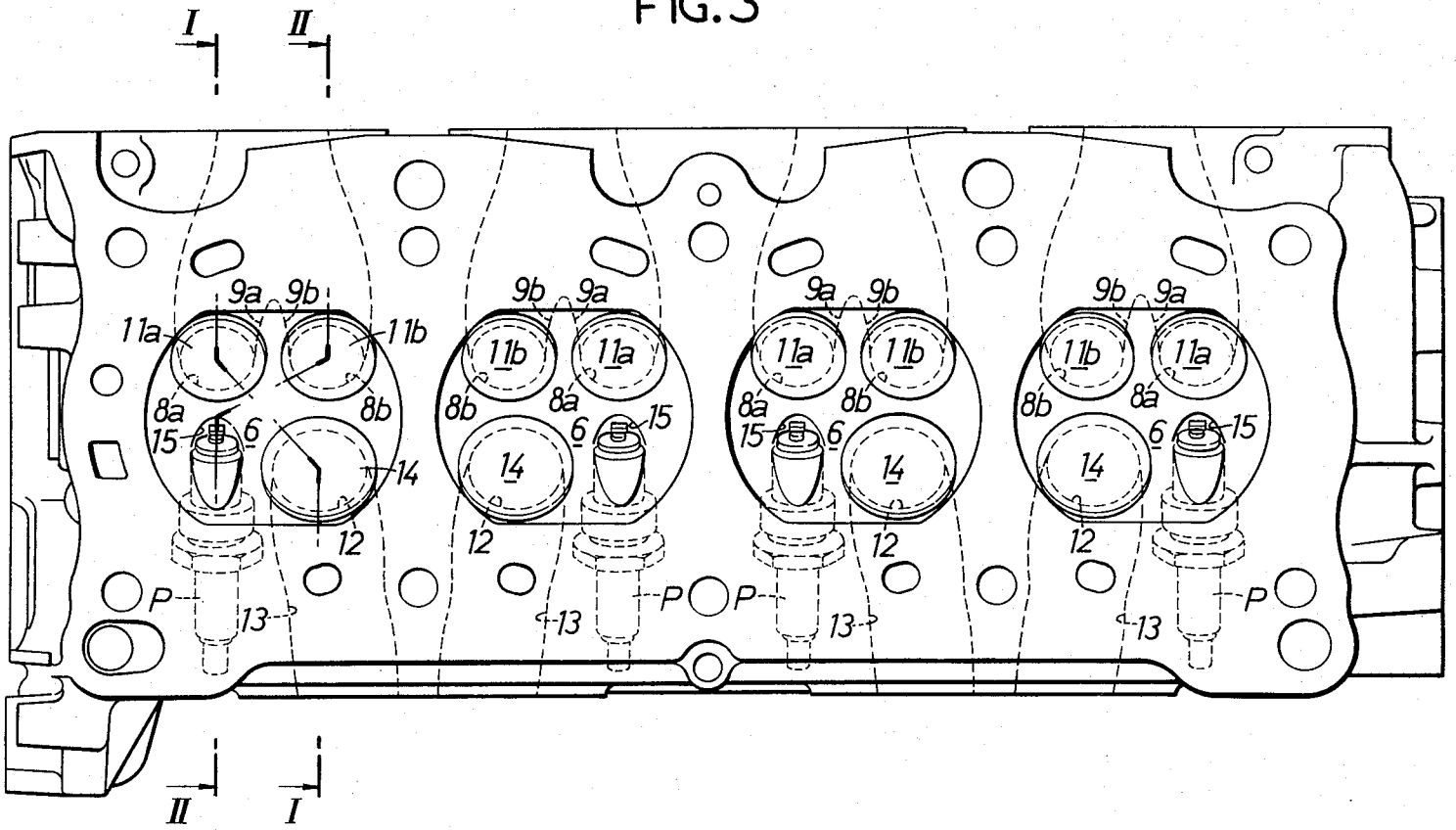

An embodiment of the present invention applied to a 4-cylinder internal-combustion engine will now be described with reference to FIGS. 1–5.

An engine body E of a cross-flow type of 4-cylinder internal-combustion engine is provided with a cylinder block 1 having a cylinder head 2 fixed onto the cylinder block 1 via a gasket 3. Pistons 5 are fitted slidably into four cylinders 4 which are formed side by side in the cylinder block 1. Combustion chambers 6 facing the upper surfaces of the pistons 5 are formed in the inner surface of the cylinder head 2. A roof surface 7 of each of the combustion chambers 6 is formed into the shape of a roof with two adjacent inclined surfaces. Two intake valve ports 8*a*, 8*b* of the same diameter open side by side on one side of the roof surface 7 in each of the combustion chambers 6. One exhaust valve port 12, the diameter of which is somewhat larger than that of the intake valve ports 8*a*, 8*b*, and a spark plug-mounting hole 15 open side by side on the other side of the roof surface 7 in each of the combustion chambers 6, opposite the suction valve port 8*b*, are provided side by side on the other side of the roof surface 7. The exhaust valve port 12 is opposite one intake valve port 8*b*, and the plug-mounting hole 15 the other intake valve port 8*a* respectively.

Intake ports 9*a*, 9*b* formed in the cylinder head 2 communicate with the two intake valve ports 8*a*, 8*b*, respectively. These intake ports 9*a*, 9*b* are joined together within the cylinder head 2 so as to open onto one side surface thereof and communicate through an intake manifold In with a fuel supply means, for example a carburetor 10. The single exhaust valve port 12 communicates with an exhaust port 13 formed in the cylinder head 2. The exhaust port 13 opens into another side surface of the cylinder head 2 to communicate with an exhaust system through an exhaust manifold Em.

An ignition source, i.e. a spark plug P, is screwed to the spark plug-mounting hole 15 from the exhaust side of the cylinder head 2.

A pair of intake valves 11*a*, 11*b*, adapted to open and close the intake valve ports 8*a*, 8*b*, and an exhaust valve 14 adapted to open and close the exhaust valve port 12, are supported on the cylinder head 2 in such a manner that the valves 11*a*, 11*b*, 14 can move slidingly up and down in the valve ports 8*a*, 8*b*, 12, respectively. The intake valves 11*a*, 11*b* and exhaust valve 14 are disposed so that they are inclined on both sides of the axis L—L of the cylinder 4 in such a manner that the stem ends of the valves 11*a*, 11*b*, and 14 are separated from each other. A cam shaft 17 is disposed along a straight line substantially equidistant from the intake valves 11*a*, 11*b* and the exhaust valve 14 so as to extend in the lengthwise direction of the cylinder head 2. The cam shaft 17 is supported rotatably on the cylinder head 2 by a plurality of bearings 18, and is driven in accordance with the rotational movement of a crankshaft in the usual manner. An intake-side rocker arm shaft 19 and an exhaust-side rocker arm shaft 20 are supported by a plurality of bearings 21, 22 on parts of the cylinder head 2 which are between the intake valves 11*a*, 11*b* and the cam shaft 17, and between the exhaust valve 14 and the cam shaft 17, respectively, in such a manner that the rocker arm shafts 19, 20 extend parallel to the cam shaft 17. Two intake-side rocker arms 23*a*, 23*b* for each cylinder are supported pivotably on the intake-side rocker arm shaft 19, the outer ends of the rocker arms 23*a*, 23*b* engaging with the stem ends of the intake valves 11*a*, 11*b*, respectively, via adjusters 25. Slipper surfaces 27 at the inner ends of the rocker arms 23*a*, 23*b* engage with the upper surface of intake-side valve-actuating cams 29 mounted on the cam shaft 17. One exhaust-side rocker arm 24 for each cylinder is supported pivotably on the exhaust-side rocker arm shaft 20. The outer end of the rocker arm 24 engages with the upper end of the exhaust valve 14 via an adjuster 26, and a slipper surface 28 at the inner end of the rocker arm 24 engages with upper surface of an exhaust-side valve-actuating cam 30 mounted on the cam shaft 17. When the cam shaft 17 rotates, the intake-side rocker arms 23*a*, 23*b* and the exhaust-side rocker arms 24 pivot about the rocker arm shafts 19, 20 to open and close the intake valves 11*a*, 11*b* and exhaust valves 14 in cooperation with valve springs 31, 32.

Figure 4:
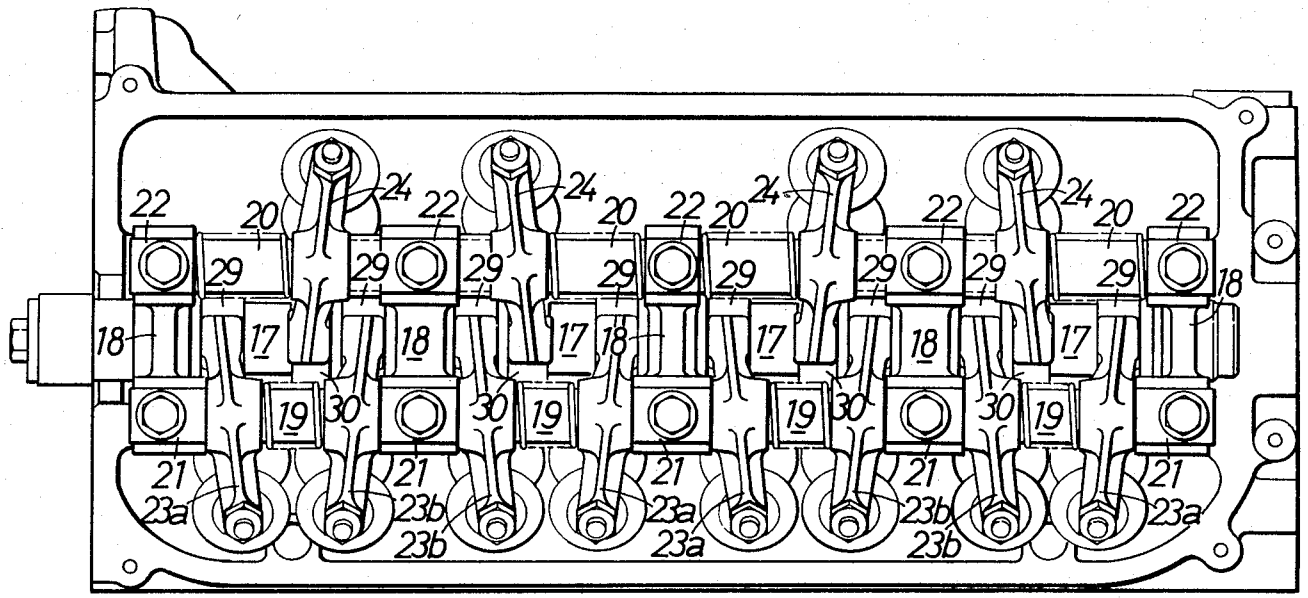

As shown in FIG. 4, valve-actuating cams 29, 29 for operating the intake-side rocker arms 23*a*, 23*b* are mounted on parts of the cam shaft 17 which are on both sides of a valve-actuating cam 30 for operating the exhaust-side rocker arm 24 of the corresponding cylinder head, in such a manner that the cams 29, 30 are arranged side by side along the axial direction of the cam shaft 17. The cam shaft 17 is supported at parts thereof which are close to the outer sides of these valve-actuating cams 29 by the bearings 18. Accordingly, even when the two intake valves 11*a*, 11*b* are actuated simultaneously to make the load applied to the cam shaft 17 increase, the cam shaft 17 is not deflected, and the intake valves 11*a*, 11*b* and exhaust valve 15 are opened and closed at predetermined timings.

Figure 5:
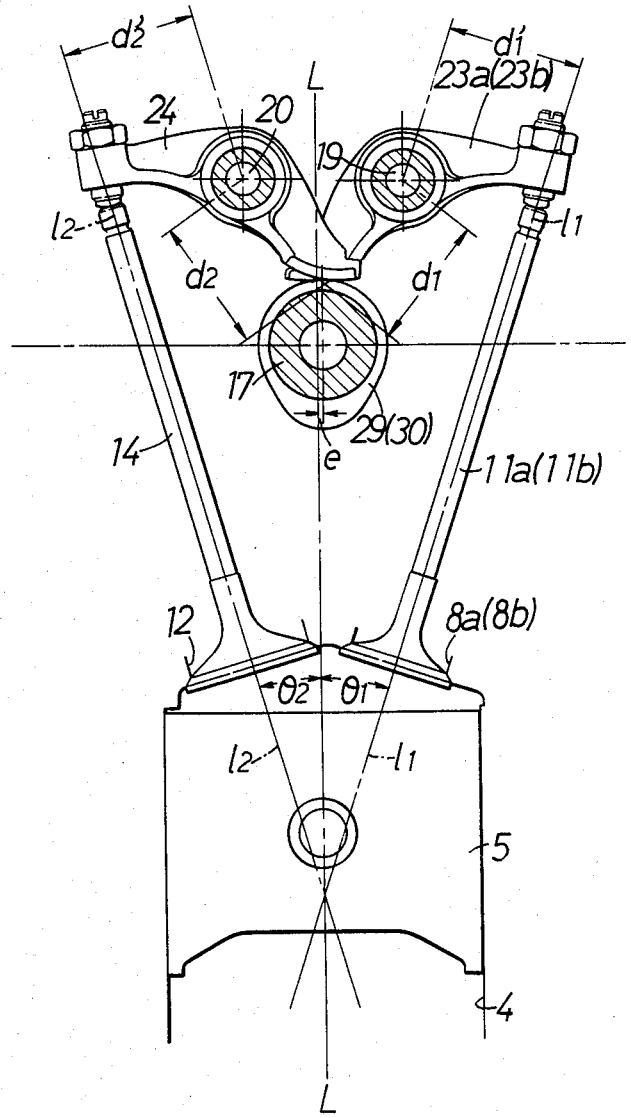

One of the two intake rocker arms 23*a*, 23*b* and the exhaust rocker arm 24 for each cylinder are formed to the same dimensions to make the two rocker arms interchangeable. Consequently, the intake valves 11*a*, 11*b*, exhaust valve 14, cam shaft 17, and rocker arm shafts 19, 20 can be arranged, for example, in the following positional relationship. As shown in FIG. 5, the intake valve ports 8*a*, 8*b* are formed to have a diameter somewhat smaller than that of the exhaust valve port 12. The angle of inclination $\theta_1$ between the axis $l_1$—$l_1$ of the intake valves 11*a*, 11*b* and that L—L of the cylinder is somewhat greater than the angle of inclination $\theta_2$ between the axis $l_2$—$l_2$ of the exhaust valve 14 and that L—L of the cylinder. Since it is necessary to position the cam shaft 17 along a straight line equidistant from the intake valves 11*a*, 11*b* and the exhaust valve 14, the axis of the cam shaft 17 is separated from the axis L—L of the cylinder toward the intake valves 11*a*, 11*b* by an eccentricity e. When the difference between $\theta_1$ and $\theta_2$ is increased, the eccentricity e naturally increases. The intake-side rocker arm shaft 19 and exhaust-side rocker arm shaft 20 are also separated from the axis L—L of the cylinder toward the intake valves 11*a*, 11*b* in accordance with an eccentricity e, by which the cam shaft 17 is separated from the axis of the cylinder. The positions of the first and second arm shafts 19, 20 are determined in such a manner that the distance $d_1$ between the axis of the rocker arm 19 and the point of contact of the rocker arm 23*a* or 23*b* with the valve-actuating cam 29, and the distance $d_2$ between the axis of the rocker arm 20 and the point of contact of the rocker arm 24 with the valve-actuating cam 30 are equal to each other, i.e. $d_1=d_2$; and the distance $d_1'$ between the axis of the rocker arm shaft 19 and the point of contact of the rocker arm 23*a* or 23*b* with the main intake valve 11*a* or 11*b*, and the distance $d_2'$ between the axis of the rocker arm shaft 20 and the point of contact of the rocker arm 24 with the exhaust valve 14 are equal to each other, i.e. $d_1'=d_2'$.

As shown in FIG. 4, the cams engaging with one of the intake-side rocker arms 23*a* or 23*b* and the exhaust-side rocker arm 24, which are formed to have the same shape, are positioned in such a manner that the interchangeability of these two rocker arms, referred to previously, can be obtained with a required area of the slipper surfaces thereof and a required gap between these cams maintained between the bearings 18.

When the relative positions of the cam shaft 17, intake valves 11*a*, 11*b*, exhaust valve 14, intake-side rocker arm shaft 19,and exhaust-side rocker arm shaft 20, and the arrangement of the cams 29, 30 are determined as described above, one of the pair of intake-side rocker arms 23*a*, 23*b* and the exhaust side rocker arm 24 can be formed to have the same dimensions to make these two rocker arms interchangeable. Furthermore the two intake valves 11*a*, 11*b* can also be formed to have the same dimensions to make them interchangeable.

Figure 6:
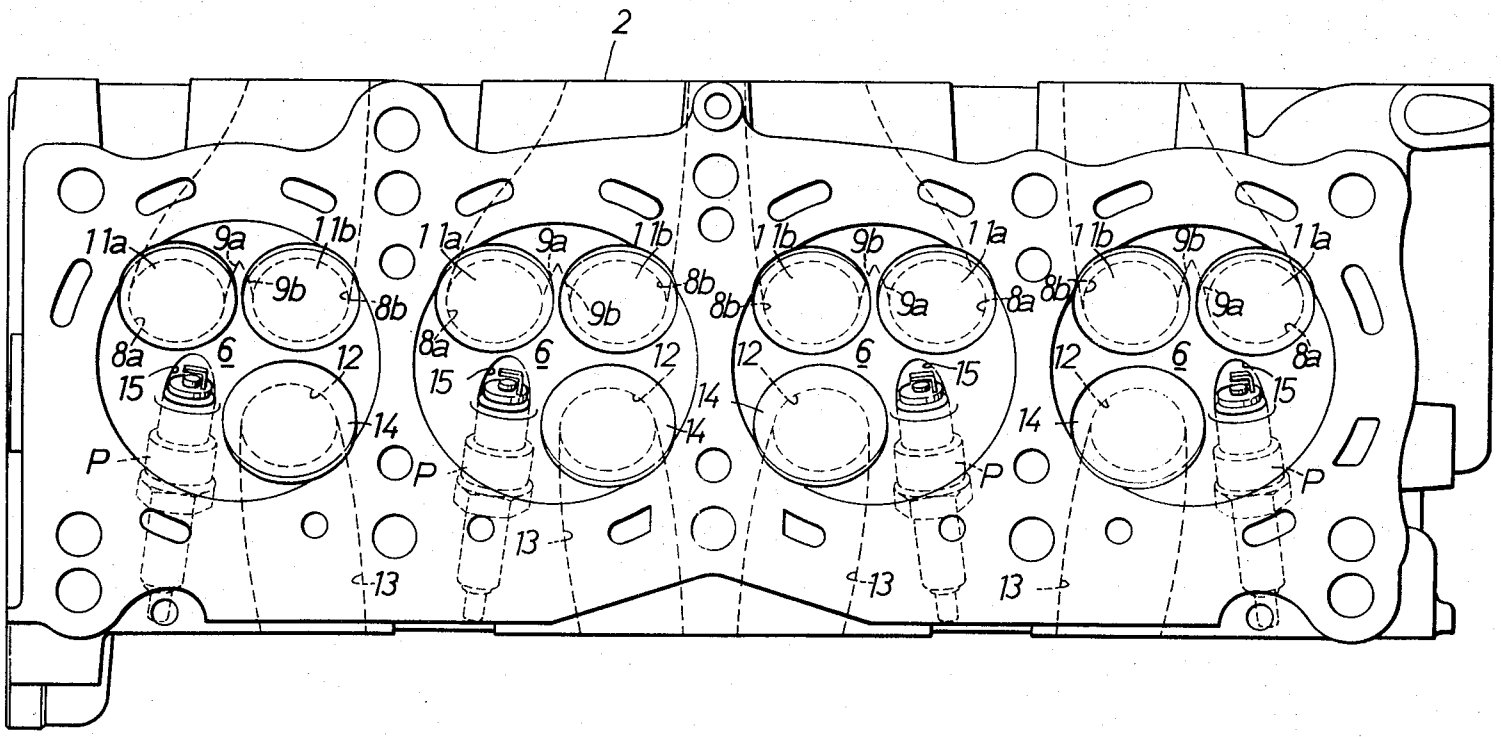
Figure 7:
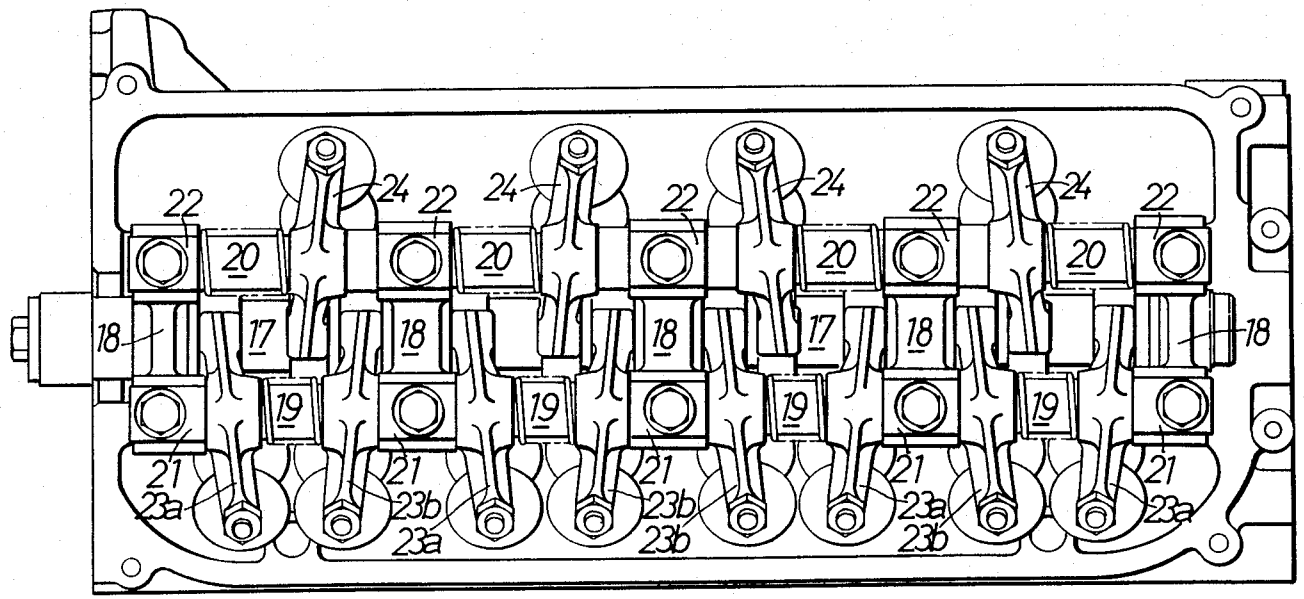

FIGS. 6 and 7 show a second embodiment of the present invention. In the second embodiment, the arrangement of the exhaust valves 14 and the spark plugs P in the two central combustion chambers 6 of the cylinder head 2 is somewhat different from that in the first embodiment. In the second embodiment, the exhaust valves 14 of the two central combustion chambers 6 are opposite the intake valves 11*b* and positioned near to the center of the cylinder in such a manner that the valves 14 are close to each other. The spark plugs P in these combustion chambers 6 are positioned on the outer side of these two exhaust valves 14, in such a manner that the spark plugs P sandwich the exhaust valves 14 between them. This arrangement enables the exhaust branch pipes extending from the exhaust manifold and communicating with the two exhaust ports in the central portion of the cylinder head 2 to be brought close to each other or be joined together.

As described above, a first embodiment of the invention provides a valve-actuating mechanism for a three-valve internal-combustion engine having two intake valves and one exhaust valve with a single cam shaft disposed along a straight line substantially equidistant from the intake valves and the exhaust valve. Valve-actuating cams mounted on the cam shaft are connected to the stem ends of the intake valves and the exhaust valve by intake rocker arms and an exhaust rocker arm which are supported pivotably on rocker arm shafts. One of the intake rocker arms and the exhaust rocker arem are formed to have the same dimensions to make these two rocker arms interchangeable. This enables the cost of manufacturing such an engine to be reduced to a great extent.

A second embodiment of the invention provides a valve-actuating mechanism for a three-valve multi-cylinder internal-combustion engine having two intake valves and one exhaust valve for each cylinder with a single cam shaft disposed along a straight line substantially equidistant from the plurality of pairs of intake valves and the plurality of exhaust valves. Valve-actuating cams mounted on the cam shaft are connected to the stem ends of the intake valves and exhaust valves by intake rocker arms and exhaust rocker arms pivotably supported on rocker arm shafts. One of each pair of intake rocker arms and the exhaust rocker arms are formed to have the same dimensions to make these two rocker arms interchangeable. The number of types of rocker arms can be minimized to reduce the cost of manufacturing the valve-actuating unit. The valve-actuating cams consist of two intake valve-actuating cams and one exhaust valve-actuating cam for each cylinder, mounted on parts of the cam shaft which are adjacent to one another and are between two bearings rotatably supporting the cam shaft, so that the cam shaft does not deflect even when the two intake valves are operated at substantially the same time so that a high load is applied thereto. The intake valves and exhaust valves are always operated at accurate timings. This valve-actuating mechanism for a three-valve multi-cylinder internal-combustion engine is able to provide a reduction in the diameter of the cam shaft, compared with a conventional mechanism of this kind, to contribute to a reduction in the weight of the engine.

The present invention is not, of course, limited to the above embodiments; it may be modified in various ways within the scope of the appended claims.

What is claimed is:

1. In a three-valve internal-combustion engine having a combustion chamber formed in the inner surface of a cylinder head so as to face the upper surface of a piston, two intake valves arranged side by side on one side of a roof surface of said combustion chamber, and an exhaust valve and an ignition source disposed on the other side thereof, a valve-actuating mechanism comprising: a cam shaft axially disposed along a straight line substantially equidistant from said intake valves and said exhaust valve; two intake valve-actuating cams and one exhaust valve-actuating cam mounted on said cam shaft, said exhaust valve-actuating cam being disposed between said two intake valve-actuating cams, with said two intake valve-actuating cams being symmetrically parallel to each other; rocker arm shafts supported on said cylinder head so as to extend parallel to said cam shaft; and intake rocker arms and an exhaust rocker arm pivotably mounted on said rocker arm shafts, said valve-actuating cams and the stem ends of said two intake valves and said exhaust valve engaging said intake rocker arms and said exhaust rocker arm, respectively, one of said two intake rocker arms and said exhaust rocker arm being formed to have the same dimensions for interchangeability therebetween.

2. In a three-valve multi-cylinder internal-combustion engine having a plurality of combustion chambers formed in the inner surface of a cylinder head so as to face the upper surfaces of pistons, two intake valves arranged side by side on one side of the roof surface of each of said combustion chambers, and an exhaust valve and an ignition source disposed on the other side of said roof surface, a valve-actuating mechanism comprising : a cam shaft axially disposed along a straight line substantially equidistant from said plurality of pairs of intake valves and said plurality of exhaust valves; a plurality of sets of valve-actuating cams each corresponding to one cylinder, all of which cams being mounted on said cam shaft; an intake rocker arm shaft and an exhaust rocker arm shaft supported on said cylinder head so as to extend parallel to said cam shaft; a plurality of sets of two intake rocker arms, each corresponding to one cylinder; and a plurality of exhaust rocker arms, each corresponding to one cylinder, all of said rocker arms being pivotably mounted on corresponding rocker arm shafts, each set of said valve-actuating cams on said cam shaft and the stem ends of the corresponding intake valves and exhaust valves engaging the corresponding set of intake rocker arms and the corresponding exhaust rocker arms, one of said intake rocker arms in each pair and the corresponding exhaust rocker arm being formed to have the same dimensions to make said two rocker arms interchangeable; and each set of said valve-actuating cams consisting of the two intake valve-actuating cams mounted side by side on a part of said cam shaft which is between two bearings rotatably supporting said cam shaft, said one exhaust valve-actuating cam being disposed between said two intake valve-actuating cams.

* * * * *